United States Patent [19]

Whitten

[11] 4,144,733

[45] Mar. 20, 1979

[54] PIPE GROOVING APPARATUS

[76] Inventor: Billy L. Whitten, Rte. 5, LaFayette, Ga. 30728

[21] Appl. No.: 846,538

[22] Filed: Oct. 28, 1977

Related U.S. Application Data

[63] Continuation-in-part of Ser. No. 836,933, Sep. 27, 1977, abandoned.

[51] Int. Cl.[2] ..... B21D 37/04

[52] U.S. Cl. ..... 72/105; 72/444; 74/16

[58] Field of Search ..... 72/105, 444; 74/16; 10/107 PH

[56] References Cited

U.S. PATENT DOCUMENTS

| | | | |
|---|---|---|---|
| 2,024,803 | 12/1935 | Nelson | 72/105 |
| 2,555,723 | 6/1951 | Woods | 74/16 |
| 2,603,975 | 7/1952 | Shoffner | 74/16 |
| 3,541,826 | 11/1970 | Halliburton | 72/105 |
| 3,662,414 | 5/1972 | Behnke | 10/107 PH |
| 3,903,722 | 9/1975 | Thau, Jr. et al. | 72/105 |

*Primary Examiner*—Lowell A. Larson
*Attorney, Agent, or Firm*—Craig & Antonelli

[57] ABSTRACT

A portable pipe grooving apparatus includes a pair of mating rollers mounted upon a frame so as to be radially adjustable with respect to each other. One of the mating rollers is connected to a rotatable shaft which extends rearwardly from the apparatus so as to enable the apparatus to be coupled with a drive means which is removably associable with the shaft for rotating the one roller. The frame further includes a coupling means for detachably connecting the frame to the drive mechanism by projections carried by the drive means slidably engaging within annular socket elements, which socket elements also serve as supporting legs for the frame.

9 Claims, 4 Drawing Figures

PIPE GROOVING APPARATUS

BACKGROUND AND SUMMARY OF THE INVENTION

The present application is a continuation-in-part of copending U.S. Pat. application Ser. No. 836,933, filed Sept. 27, 1977, now abandoned, the subject matter of which is hereby incorporated by reference, and the benefit of the earlier filing date is hereby claimed for all common subject matter.

The present invention relates to pipe grooving apparatus, and more particularly to apparatus for grooving pipes such as are commonly used in plumbing and sprinkling installations.

In the past, pipes for such plumbing installations as sprinkler systems have been connected by providing the pipes with threads. However, since pipe is conventionally sold by weight, and since pipe threading is a procedure that requires pipes of thicker walls than other connecting arrangements, to reduce costs the trend in plumbing installations has been away from threading thick wall pipe and towards the grooving of thinner wall pipe.

Machines currently are known for grooving steel water pipes, and the like, but such apparatus weigh upwards of 450 to 500 pounds, are not portable, and due to their construction and manner of operation, require two persons to operate them.

Likewise, various types of machinery have been known for close to a century which utilize a pair of rollers to deform tubular sheet metal structures by placing the structure to be deformed about one of the rollers, radially adjusting the other roller with respect to the roller carrying the structure to be deformed, and then rotating the roller and with it the sheet metal so as to produce a groove or projection about the circumference of the tubular structure. However, these apparatus have not been constructed in a compact and lightweight manner so as to be portable and/or have not been designed so as to be strong enough to groove the kinds of thin and thick wall pipes utilized in plumbing and sprinkler arrangements, as opposed to thin wall sheet metal.

Therefore, since the prior art pipe grooving machines have been extremely large, heavy, expensive and not portable, such machines have been maintained only in prefabricating shops and have not been useable at the job site. As such, it has been necessary for a plumbing system installer to first go to the job site, estimate exactly what components will be needed, and then wait for a prefabricating shop to groove the appropriate pipes. Furthermore, if once the installation of the pipe has begun a problem should arise which requires different or additional grooved pipe sections, the entire job must be delayed while further grooved pipe sections are obtained from a prefabrication shop which may sometimes be a hundred miles or more from the actual job site. All of these factors create delays in the time required before a plumbing system can be fully installed, and adds to the cost of the installed system.

Accordingly, it is an object of the present invention to provide a compact, lightweight and portable type grooving apparatus.

It is a further object of this invention to provide a pipe grooving apparatus which may be easily operated by one person.

It is yet another object of this invention to provide a pipe grooving apparatus which is sufficiently strong to groove both thin and thick wall pipes as well as thin gauge sheet metal.

It is yet another object of the present invention to achieve the above noted objects in a machine that is both simple and inexpensive to manufacture.

According to the present invention, a portable type grooving apparatus is formed by a frame to which a pair of mating rollers is attached such that one of the rollers can be radially adjusted with respect to the other of the rollers. A lighweight, compact, portable design is achieved in a driveless construction wherein one of the rollers is connected to a rotatable shaft which extends rearwardly from the apparatus so as to be removably associated with conventional power machines such as are normally found on plumbing and sprinkling installation jobs and by providing the frame with a coupling structure for connecting the frame to the drive means.

According to another aspect of the invention, accurate positioning of a pipe to be grooved is achieved by providing the roller which receives the pipe with an annular abutment flange. Furthermore, for providing the apparatus with adaptability for grooving different size pipes and/or creating grooves of differing sizes, shapes, or numbers, the rollers are detachably mounted in a simple fashion that enables substituting of one roller for another in a quick, efficient manner.

The above and other features, advantages and objects of the present invention will be apparent from the following detailed description of the present invention when viewed in conjunction with the accompanying drawings.

DETAILED DESCRIPTION OF THE INVENTION

Figure 4:
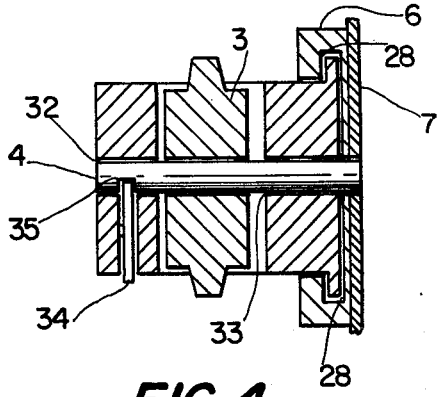
FIG. 4 is a cross-sectional view taken along line IV—IV of FIG. 1 illustrating the upper roller and slide support mounting arrangement.
Figure 3:
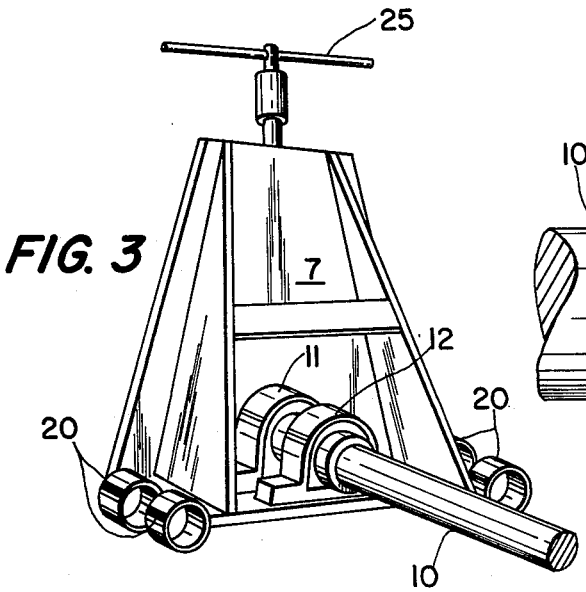
FIG. 3 is a perspective view of the present invention viewed from the rear and slightly to the side thereof.

Referring to the drawings, it can be seen that the pipe grooving apparatus according to the present invention has a frame 1 upon which a pair of mating rollers 2 and 3 are supported. The roller 3 is freely rotatable upon a shaft 4 which is carried by a roller housing 5. The housing 5 is slidably supported upon a track plate 6 that is mounted to a vertical wall 7 of the frame 1, and as best shown in FIG. 4, a suitable slide mounting can be achieved by housing 5 with flanges 27 that can move vertically within receiving slots 28 formed by track plate 6. Vertical displacement of the roller housing 5, and with it the roller 3, radially with respect to the roller 2, is achieved by rotating a threaded shaft 8 within a complementary threaded block 9 mounted to the wall 7 of the frame 1.

The roller 2 is a rotatably driveable with respect to the roller 3 by being mounted upon a shaft 10. The shaft 10 is rotatably supported in a pair of pillow block bearings 11 and 12 which are mounted to a frame 1. The roller 2 is retained upon the shaft 10 by abutting a retaining plate 13 against the end surfaces of the roller 2 and shaft 10 through the agency of a threaded bolt 14 being fastened within a threaded opening 15 in the shaft 10.

Figure 2:
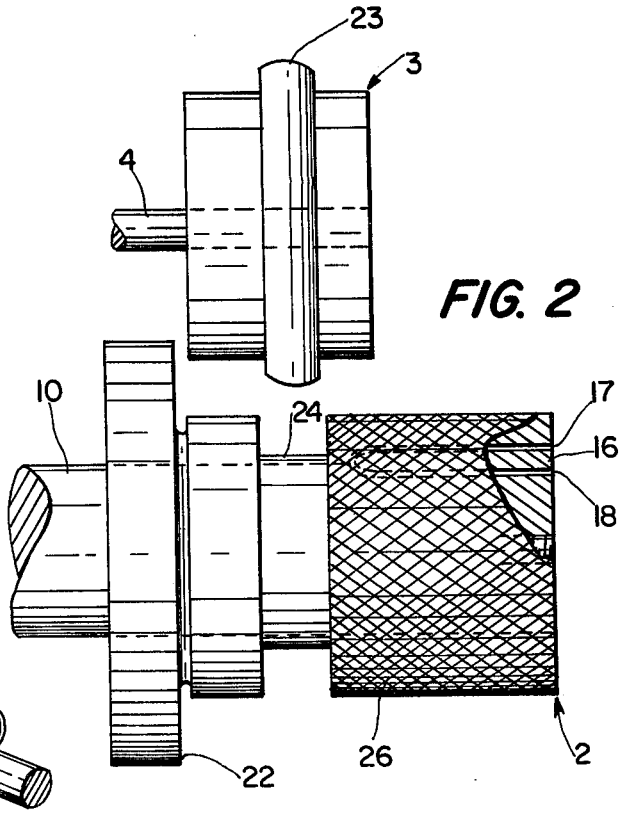
FIG. 2 is a side view of the mating rollers shown partially in elevation and partially in cross-section.

As can be seen from FIG. 2, relative rotation between the shaft 10 and the roller 2 is prevented by inserting a key 16 within key seats 17 and 18 of the roller 2 and shaft 10, respectively. Alternatively, the key 16 could be formed as an integral projection within the roller 2 which can mate with a single key seat 18 within the shaft. In this manner, by merely unfastening the bolt 14, rollers 2 of various sizes can be interchangeably mounted so as to facilitate the grooving of various different sized pipes and/or provide different sized grooves.

To ensure accurate positioning of the groove in the workpiece, the roller 2 is provided with an abutment flange 22 extending about the circumference thereof. Additionally, the roller 3 is provided with an appropriately positioned circumferential rib 23 which is sized to correspondingly mate with a circumferential groove 24 in the roller 2 for the purpose of creating the groove in the pipe wall. As can be appreciated from FIG. 2, the roller 3 has an axial length which is significantly longer than is necessary to achieve the grooving of a pipe. The reason for this extended length of the roller 3 is that by substituting various rollers 3 which have their ribs 23 positioned along various different points along the length thereof, various different sized and positioned grooves can be achieved in conjunction with the replaceable roller 2.

The interchangeability of the roller 3 is achieved by virtue of the mounting arrangement shown in FIG. 4. The roller 3 is supported upon a shaft 4 in a freely rotatable manner. The shaft 4 is supported by the depending flange-like portions 30, 31, which have apertures 32, 33, respectively, within which the shaft 4 is slidably received. The shaft 4 is retained within the apertures 32, 33 by a conventional set screw 34 which engages in a notch or groove 35 in shaft 4. Thus, to replace a specific roller 3 with another, one need only back-off set screw 34 from groove 35, and then slide out shaft 4 from the housing 5 until the roller 3 is removed therefrom. The roller 3 can then be taken from the housing 5 and a different roller substituted.

Additional compactness, and reductions in cost and weight are achieved by eliminating any drive mechanism as part of the pipe grooving apparatus according to the present invention. However, since a drive means is essential to rotating the shaft 10, and with it the roller 2, for producing a circumferential groove in tubular structures such as pipes, the pipe grooving apparatus according to the present invention has been designed so as to be easily and quickly associateable with conventional power machines such as are normally utilized in most plumbing and sprinkler installation operations. Such power machines conventionally have a jaw-like gripping chuck (similar to that found in power drills for gripping drill bits) and a pair of tool holding projections. One such suitable machine is manufactured by the Rigid Tool Company and is designated by the model name RIGID 300, and while this particular machine is cited by way of example, any such power machine would be suitable for use with the present invention.

Figure 1:
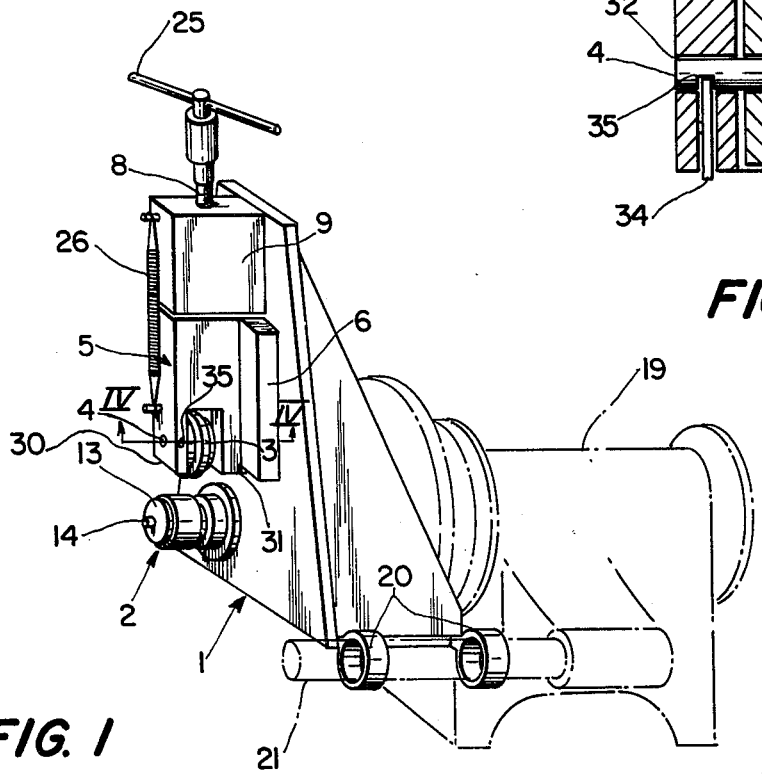
FIG. 1 is a frontal perspective view of a portable pipe grooving apparatus according to the present invention with a conventional power drive machine shown coupled thereto in outline.

For the purpose of illustrating how one of the abovedescribed power machines can be removably associated with the apparatus according to the present invention for the purpose of driving one of the grooving rollers, one such machine is designated generally at 19 in FIG. 1. As can be seen in FIG. 1, the frame 1 is provided on both sides thereof with coupling sleeves 20 within which the tool-holding projections 21 of the power machine 19 can be slidably engaged. By this arrangement when the shaft 10, which extends rearwardly beyond the frame 1 so as to be gripped within the chuck of the power machine 19, has a driving force applied thereto, the shaft 10 will rotate as relative rotation between the frame 1 and the power machine 19 will be prevented. Furthermore since the grooving apparatus has no drive, and since the drive shaft is designed so as to be coupled directly to the power machine without any intervening transmission, a simple and rugged arrangement is provided that can be subjected to commonplace abuses, such as being thrown into a truck by a workman going to or leaving a job site, with fear of damage to the apparatus.

By way of example only, it has been found that by forming the frame of standard $\frac{1}{2}$ inch and $\frac{3}{8}$ inch steel, forming the rollers or air-hardened die steel, so as to have an outer diameter of approximately $1\frac{3}{4}$ to $2\frac{3}{4}$ inches and utilizing a 30 inch long $1\frac{1}{4}$inch diameter steel drive shaft, the result is that an effective pipe grooving apparatus can be achieved that has an approximate weight of only 45 pounds, yet which can, as an attachment for use with conventional power machines, groove thin and thick wall pipes 2 to 8 inches in diameter.

To operate the above-described pipe grooving apparatus, rollers 2 and 3 having the appropriate size, shape, number, and position, ribs and/or grooves are mounted upon the shafts 10 and 4. The grooving apparatus is then joined to the power machine 19 by sliding the sockets of the coupling sleeves 20 onto the projections 21, and the shaft 10 into the chuck of the power machine 19 where it can be appropriately clamped thereby. Furthermore, since shaft 10 and coupling sleeves 20 are oriented parallel to each other, the uniting of the projections 21 with the sleeves 20, and the power machine's chuck with the shaft 10 can both be accomplished in single, simple sliding movement by one person.

The pipe to be grooved is then slid on to the roller 2 until it comes into engagement with the circumferential flange 22. The handle 25 is then rotated so as to rotate and vertically displace the shaft 8, thereby displacing the housing carrying the roller 3 downwardly into engagement with the outer surface of the pipe. The power machine is then activated so as to rotate the shaft 10, thereby causing the roller 2 to rotate. Due to the frictional engagement between the pipe and the roller 2 caused by the top roller 3 pressing the pipe thereagainst, the pipe is caused to rotate. This frictional engagement between the roller 2 and the pipe can be further improved by providing the outer surface 26 of the roller 2 with a heavy knurl, such as is illustrated in FIG. 2.

As the pipe turns, the top roller 3 presses the pipe groove down into the recess 24 of the lower roller 2, and the upper roller 3 can be progressively lowered until the groove depth needed is achieved. Once the desired groove is finished, the rotative drive for the roller 2 is discontinued, and the handle 25 is reversed so as to cause the upper roller 3 to be lifted out of the groove formed in the pipe with the assistance of return spring 25. Then, since the roller 2 is selected so as to have a maximum outer diameter which is less than the minimum inner diameter of the grooved pipe, the pipe can then be lifted and slid off of the lower roller 2.

Accordingly, it can be seen from the above description that the present invention provides a portable pipe grooving apparatus which is light and compact, yet strong enough to groove various types of pipe, whether thin or thick wall, and of various diameters, as well as being simple to operate by only one person.

Additionally, it will be obvious to those skilled in the art that various changes may be made in the invention without departing from the spirit and scope thereof, and therefore the invention is not to be limited by that which is shown in the drawings and described in the specification, but only by the scope of the appended claims.

I claim:

1. A portable pipe grooving apparatus comprising frame means, grooving means mounted to said frame means and including a pair of mating rollers, said rollers being radially adjustable with respect to each other, one of said rollers being connected to rotatable shaft means, said shaft means extending rearwardly from said apparatus for coupling said one roller to a drive means removably associable with said shaft means for rotatively driving said one roller, coupling means for detachably connecting said frame means to said drive means, said coupling means including socket means on said frame for slideably receiving projections carried by said drive means, said socket means being sleeves fixed to said frame means as lowermost and outermost portions thereof so as to form supporting legs for said frame means and wherein said drive means is a multi-purpose power machine having a chuck, said shaft means being slidably receivable within said chuck when said projections are slid within said socket means.

2. A portable pipe grooving apparatus according to claim 1, wherein a first of said pair of mating rollers constitutes a grooved pipe receiving roller and a second of said rollers constitutes a ribbed groove forming roller, said pipe receiving roller being provided with an annular abutment flange extending radially therefrom for positioning said pipe relative to said groove forming roller.

3. A portable pipe grooving apparatus according to claim 2, wherein said one roller connected to said shaft means constitutes said pipe receiving roller and wherein said groove forming roller is mounted to said frame in a freely rotatable manner.

4. A portable pipe grooving apparatus according to claim 1, wherein said drive means is a multi-purpose power machine having a chuck, said shaft means being receivable within said chuck for enabling transmission of rotative motion from said drive means to said one roller connected to said drive means.

5. A portable pipe grooving apparatus according to claim 1, wherein said apparatus forms a structure capable of grooving pipes having a diameter of 2 to 8 inches while weighing only 45 pounds.

6. A portable pipe grooving apparatus according to claim 1, wherein said one of said pair of mating rollers connected to said rotatable shaft means is removably mounted thereon, and wherein the other of said pair of mating rollers is detachably connected with a movable roller housing.

7. A portable pipe grooving apparatus according to claim 6, wherein the connection between said other of said pair of mating rollers and said roller housing is formed by mounting said other of said rollers in a freely rotatable manner upon a support shaft which is slidably received within said housing.

8. A portable pipe grooving apparatus according to claim 7, wherein said roller housing is formed with two depending flanges, said support shaft being removably received within apertures formed in said flanges, and retaining means in said housing for engaging said support shaft.

9. A portable pipe grooving apparatus according to claim 2, wherein said pipe receiving roller has an outer surface that is knurled to increase frictional engagement between said pipe receiving roller and a pipe placed thereon.

* * * * *